US010857401B2

(12) United States Patent
Alhusseini et al.

(10) Patent No.: US 10,857,401 B2
(45) Date of Patent: Dec. 8, 2020

(54) WELL RESCUE DEVICE

(71) Applicant: King Abdul Aziz City for Science and Technology (KACST), Riyadh (SA)

(72) Inventors: Omar Mohammed Alhusseini, Riyadh (SA); Khalid Abdulrahman Aldakkan, Riyadh (SA)

(73) Assignee: KING ABDUL AZIZ CITY FOR SCIENCE AND TECHNOLOGY (KACST), Riyadh (SA)

( * ) Notice: Subject to any disclaimer, the term of this patent is extended or adjusted under 35 U.S.C. 154(b) by 0 days.

(21) Appl. No.: 14/260,275

(22) Filed: Apr. 23, 2014

(65) Prior Publication Data

US 2015/0306434 A1 Oct. 29, 2015

(51) Int. Cl.

| | |
|---|---|
| ***A62B 1/00*** | (2006.01) |
| ***E04G 3/32*** | (2006.01) |
| ***A62B 99/00*** | (2009.01) |
| ***B63C 9/02*** | (2006.01) |

(52) U.S. Cl.

CPC ..... *A62B 99/00* (2013.01); *B63C 9/02* (2013.01); *E04G 3/32* (2013.01); *A62B 1/00* (2013.01)

(58) Field of Classification Search

CPC ... B64D 1/22; B66D 3/00; E21F 11/00; A62B 1/02; A62B 1/04; A62B 35/0012; A62B 99/00; B60P 3/14; A47L 3/02; A47L 3/00; B63C 9/26; B66C 5/025; B63B 27/16

See application file for complete search history.

(56) References Cited

U.S. PATENT DOCUMENTS

| | | | | |
|---|---|---|---|---|
| 5,022,489 | A * | 6/1991 | Sauber | 182/3 |
| 2002/0046674 | A1* | 4/2002 | Kernan | 104/25 |
| 2008/0053750 | A1* | 3/2008 | Tseng et al. | 182/82 |
| 2011/0227354 | A1* | 9/2011 | Singh | 294/81.2 |

FOREIGN PATENT DOCUMENTS

| | | | |
|---|---|---|---|
| CN | 203090306 | * | 7/2013 |
| CN | 203852764 | * | 3/2014 |

* cited by examiner

*Primary Examiner* — Daniel P Cahn

(74) *Attorney, Agent, or Firm* — Steven M. Shape; Dennemeyer & Associates, LLC

(57) ABSTRACT

The invention provides a well rescue device for rescuing a victim trapped in a well. The well rescue device includes a clamp assembly configured to provide support to a torso of the victim while moving the victim. Additionally, the well rescue device includes a seat assembly configured to provide seating support to the victim.

5 Claims, 5 Drawing Sheets

WELL RESCUE DEVICE

FIELD OF THE INVENTION

The invention generally relates to a well rescue device for rescuing a victim from a well with a narrow diameter such as, but not limited to, a water well and a bore well.

BACKGROUND OF THE INVENTION

Often victims fall in uncovered or abandoned water wells and rescuing the victims poses great challenge. Typically such water wells are around 30 to 60 cm in diameter and hundreds of meters in depth. When a victim falls in such water wells, there is little room to allow rescue personnel to go inside the water well to rescue the victim.

In such cases, rescue devices are typically used for rescuing the victim. However, such rescue devices are not able to provide ample support to the victim while lifting the victim from the well. Without adequate support, the victim may be injured while being rescued.

Thus, there is a need for an improved well rescue device.

BRIEF DESCRIPTION OF THE FIGURES

The accompanying figures together with the detailed description below forms part of the specification and serves to further illustrate various embodiments and to explain various principles and advantages all in accordance with the invention.

DETAILED DESCRIPTION OF THE INVENTION

Figure 1:
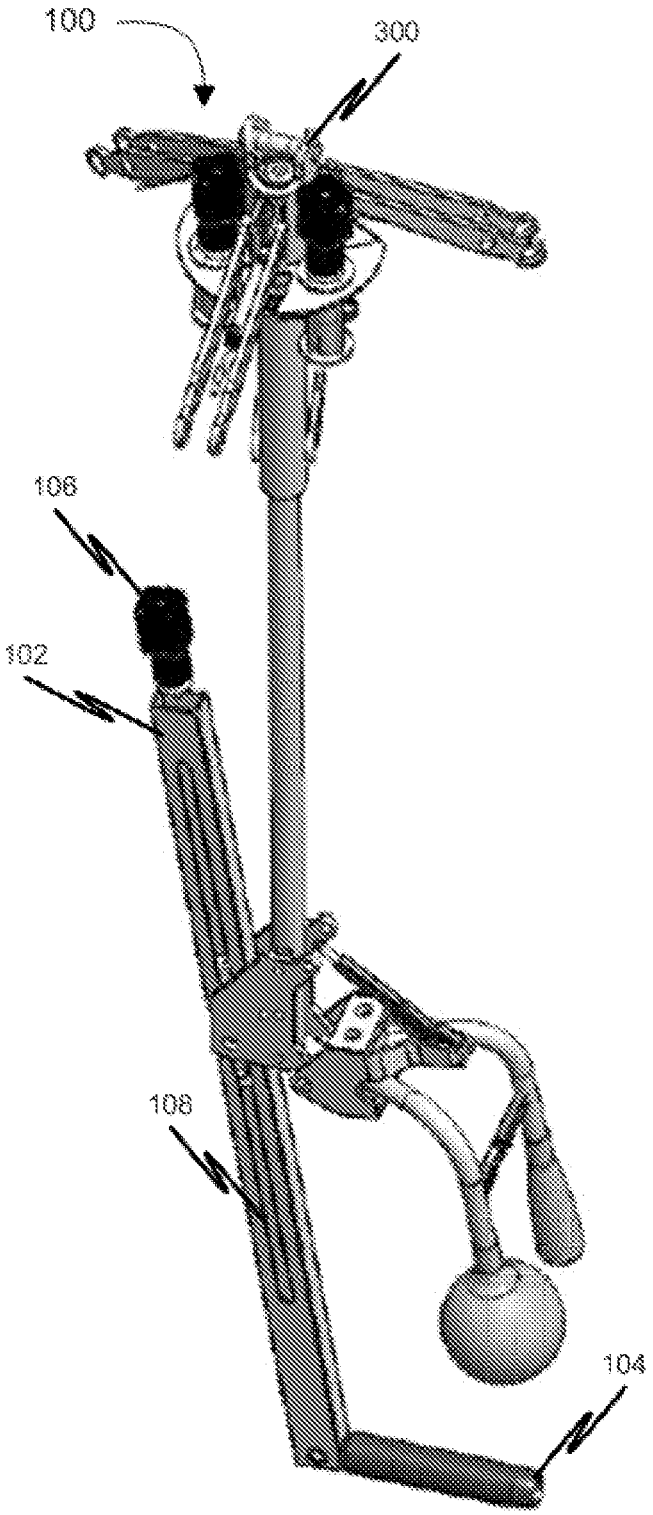
FIG. 1 illustrates a simplified diagram of a well rescue device in accordance with an embodiment of the invention.

Before describing in detail embodiments that are in accordance with the invention, it should be observed that the embodiments reside primarily in a well rescue device. Accordingly, the apparatus components have been represented where appropriate by conventional symbols in the drawings, showing only those specific details that are pertinent to understanding the embodiments of the invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article or composition that comprises a list of elements does not include only those elements but may include other elements not expressly listed or inherent to such process, method, article or composition. An element proceeded by "comprises . . . a" does not, without more constraints, preclude the existence of additional identical elements in the process, method, article or composition that comprises the element.

Generally speaking, pursuant to various embodiments, the invention provides a well rescue device that can be used for rescuing a victim trapped in a well with a narrow diameter such as, but not limited to, a water well and a bore well.

In accordance with the various embodiments, the well rescue device includes a clamp assembly and a seating assembly. The clamp assembly is configured to provide support to one or more of, a shoulder portion of the victim and a chest portion of the victim while moving the victim. The clamp assembly includes two or more clamping members that are configured to move relative to the shoulder portion of the victim. This movement enables appropriate positioning of the two or more clamp members relative to one or more of the shoulder portion and the chest portion of the victim to provide adequate support thereto.

The seating assembly is configured to provide seating support to the victim while moving the victim. The seating assembly includes a seat rod and a seat tube, wherein the seat tube can be attached with the seat rod at an end portion. Further, the seat rod can be configured such that the seat rod can move relative to the clamp assembly, wherein the movement enables adjusting a gap between the clamp assembly and the seat tube. In addition, the seat tube can be an inflatable seat tube, which can be inflated when desired to provide adequate support to the victim.

Reference will now be made to different figures for describing the well rescue device and components thereof.

FIG. 1 illustrates a simplified diagram of a well rescue device 100 in accordance with an embodiment of the invention. As shown in FIG. 1, well rescue device 100 includes a clamp assembly and a seating assembly.

In accordance with various embodiments, the clamp assembly is configured to provide support to a victim while rescuing the victim from a well. Further, the clamp assembly is configured to provide support to one or more of a shoulder portion and a chest portion of the victim. Accordingly, the clamp assembly can be configured to lock one or more of the shoulder portion and the chest portion of the victim to prevent movement of the victim while moving well rescue device 100.

Figure 2:
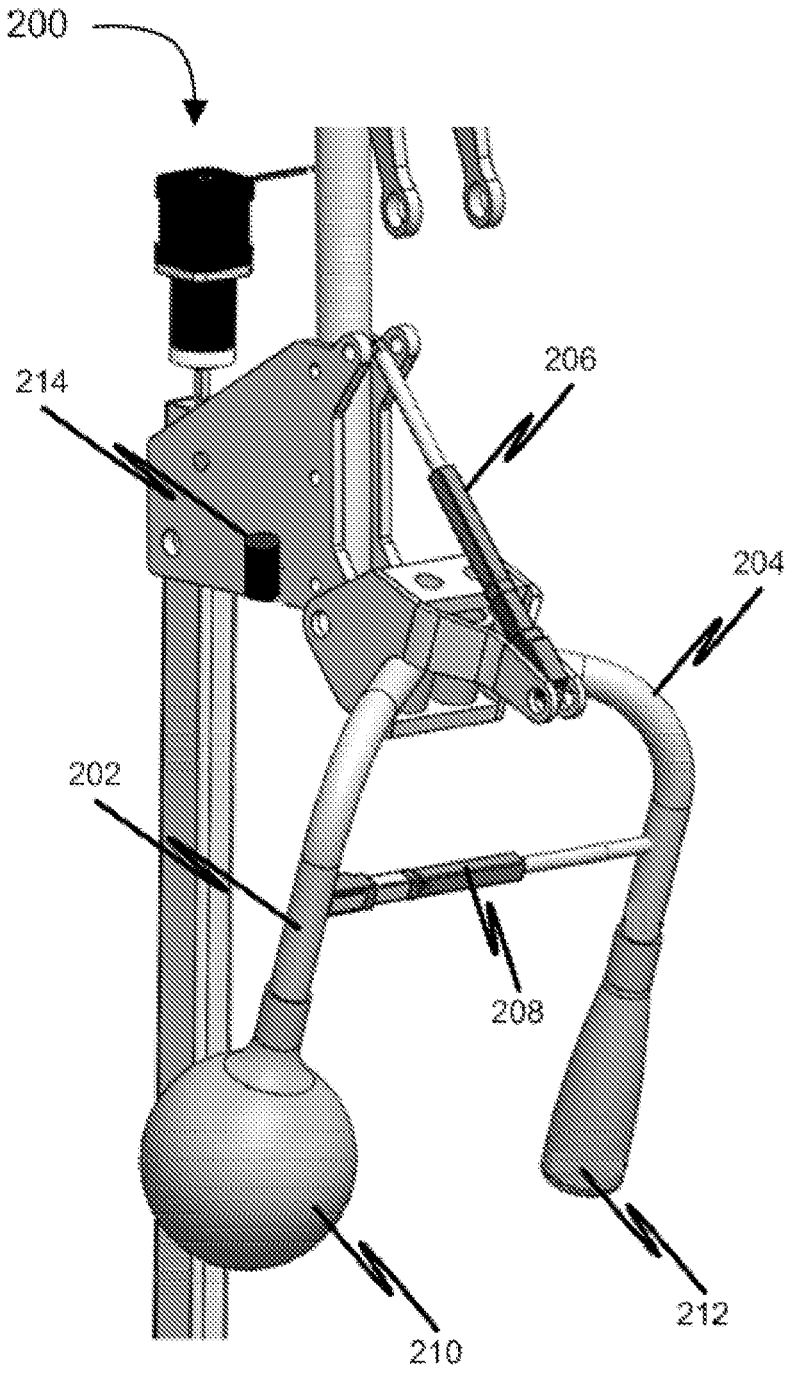
FIG. 2 illustrates a simplified diagram of a clamp assembly of the well rescue device in accordance with an embodiment of the invention.

The clamp assembly can include two or more clamping members, each of which can be configured to more relative to the shoulder portion of the victim. FIG. 2 illustrates a simplified diagram of a clamp assembly 200 in accordance with an embodiment of the invention. As shown in FIG. 2, clamp assembly 200 includes a first clamp member 202 and a second clamp member 204.

In accordance with the embodiment, one or more of first clamp member 202 and second clamp member 204 are configured to move relative to the shoulder portion of the victim. Further, the movements of first clamp member 202 and second clamp member 204 can traverse from a head portion of the victim to the shoulder portion of the victim. This ensures an up-down motion of first clamp member 202 and second clamp member 204. The up-down motion can be facilitated by use of a first linear actuator 206. Additionally, a second linear actuator 208 can be configured to adjust a gap between first clamp member 202 and second clamp member 204. This ensures appropriate positioning of first clamp member 202 and second clamp member 204 relative to one or more of the shoulder portion and chest portion of the victim. The gap between first clamp member 202 and second clamp member 204 can be adjusted according to the victim's dimensions.

Figure 3:
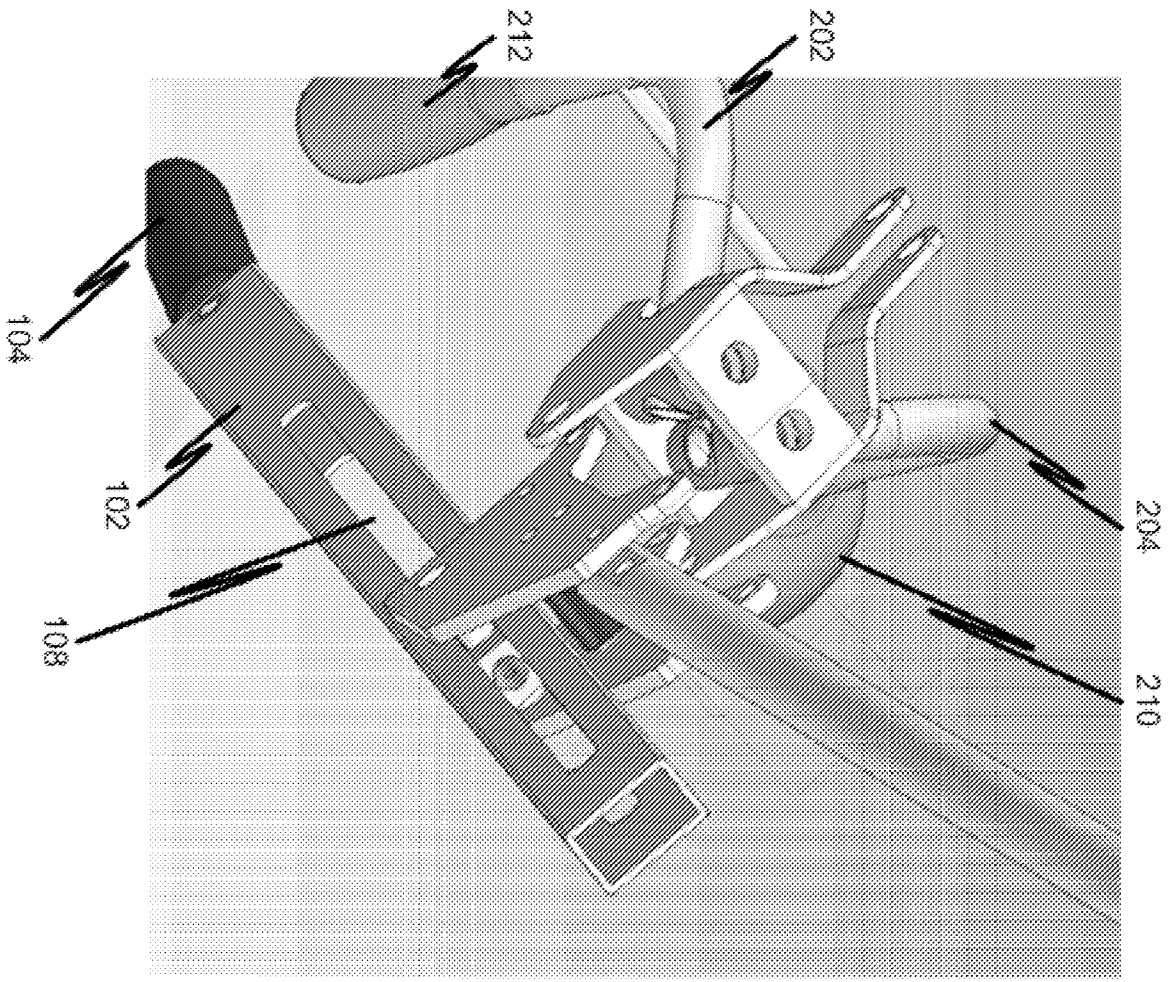
FIG. 3 illustrates another simplified diagram of the clamp assembly in accordance with the embodiment of the invention.
Figure 4:
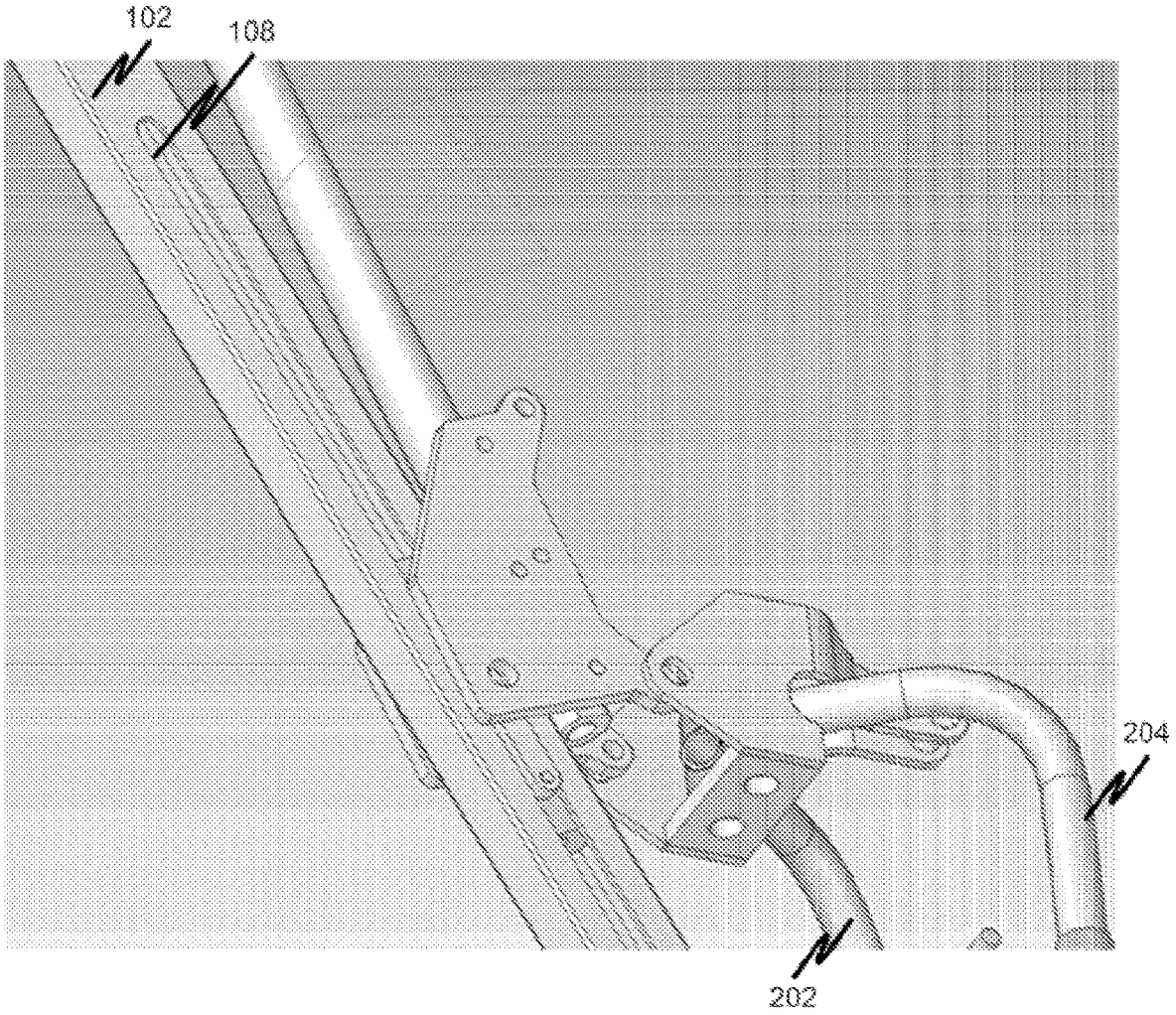
FIG. 4 illustrates yet another simplified diagram of the clamp assembly in accordance with the embodiment of the invention.

Additionally, each of first clamp member 202 and second clamp member 204 is fitted with an air bag such as a first air bag 210 and a second air bag 212 respectively. When first clamp member 202 and second clamp member 204 is at a desired position relative to the victim, then one or more of first air bag 210 and second air bag 212 can be inflated. In an embodiment, each of first clamp members 202 and second clamp member 204 is connected with an air compressor for inflation. In FIG. 2, first air bag 210 in an inflated state while second air bag 212 is in a deflated state. The inflation provides additional support to one or more of the shoulder portion and chest portion of the victim while moving the victim. FIGS. 3 and 4 illustrate alternate representations of clamp assembly 200.

Well rescue device 100 can optionally include a camera such as camera 214 illustrated in FIG. 2 for obtaining a live video feed of the victim while rescuing the victim.

The seating assembly of well rescue device 100 includes a seat rod 102 and a seat tube 104 in accordance with various embodiments.

In the embodiment illustrated in FIG. 1, a seat motor 106 is attached at a first end of seat rod 102. Seat tube 104 is attached at a second end of seat rod 102. Seat rod 102 is able to move relative to the clamp assembly. For instance, a slot 108 embedded in seat rod 102 enables seat rod 102 to move relative to the clamp assembly. The movement of seat rod 102 can be controlled using seat motor 106. The movement of seat rod 102 can be further strengthened by using a caterpillar on an outer periphery of seat rod 102. The caterpillar on an outer periphery of seat rod 102. The caterpillar is a set of ball bearings that ensure smooth movement of seat rod 102 against inner walls of the water well.

Seat rod 102 and seat tube 104 work in conjunction with each other for providing seating support to the victim. The movement of seat rod 102 enables seat tube 104 to be positioned underneath the victim. Once seat tube 104 is positioned underneath the victim, seat tube 104 can be inflated to form an air pillow for providing seating support to the victim while moving the victim. The inflation of seat tube 104 may be performed using one or more air compressors attached thereto. Additionally, a set of ball bearings can be lined along a periphery of seat tube 104 to ensure smooth movement of seat tube 104 along the inner walls of the well. In an embodiment, a total length of seat rod 102 in combination with seat tube 104 when fully extended is around 2390 mm. In another embodiment, when seat rod 102 is extended and seat tube 104 is raised the total length is around 2180 mm. In yet another embodiment, when seat rod 102 is contracted and seat tube 104 is raised the total length is 1472 mm.

Well rescue device 100 can additionally include a gripper (not shown in the figures) configured to facilitate movement of the victim relative to the clamp assembly and the seating assembly. In accordance with an embodiment of the invention, the gripper is a three finger gripper. The gripper can be configured to hold one portion of a body of the victim to position the victim such that seat tube 104 can be positioned appropriately underneath the victim. Additionally, the gripper can be used to appropriately position the shoulder portion of the victim such that the clamp assembly can secure the shoulder portion while moving the victim. The gripper especially assists in positioning the body of the victim when the victim is trapped at the bottom of the well.

Figure 5:
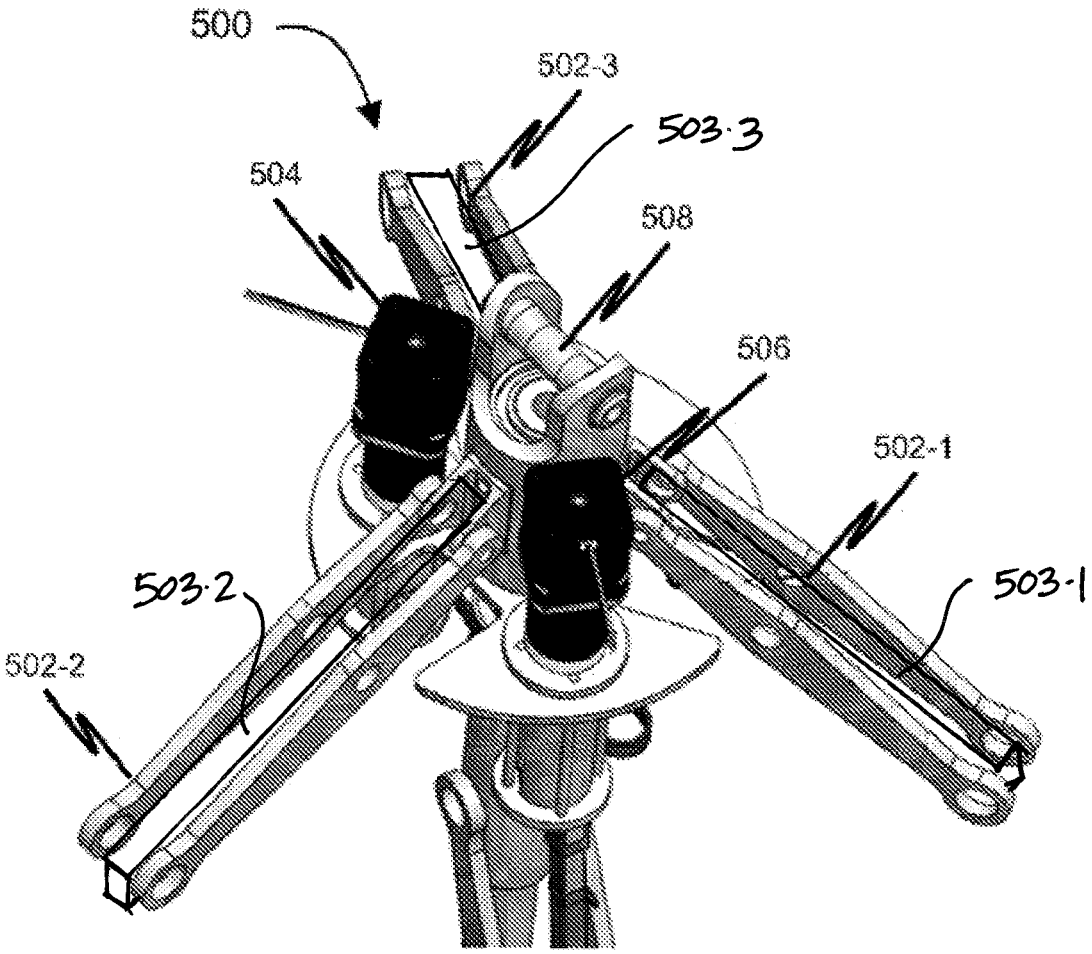
FIG. 5 illustrates a simplified diagram of a tripod assembly of the well rescue device in accordance with an embodiment of the invention.

Well rescue device 100 can also include a tripod assembly 500 configured to prevent rotation of well rescue device 100 while moving the victim. FIG. 5 illustrates a simplified diagram of a tripod assembly 500 in accordance with an embodiment of the invention.

As shown in FIG. 5 tripod assembly 500 includes three elements, namely a first element 502-1, a second element 502-2 and a third element 502-3. The three elements can be spaced apart at an angle of 120 degrees with respect to each other. Tripod assembly also includes three pneumatic actuators (shown schematically in FIG. 5), namely, a first pneumatic actuator 503-1 operatively coupled to first element 502-1, a second pneumatic actuator 503-2 operatively coupled to second element 502-2, and a third pneumatic actuator 503-3 operatively coupled to third element 502-3. The three pneumatic actuators are shown schematically in FIG. 5 and, as a result, FIG. 5 does not illustrate a specific positioning of the three pneumatic actuators. The elements 502-1, 502-2, and 502-3 of the tripod assembly 500 can be extended via corresponding pneumatic actuators 503-1, 503-2, and 503-3, respectively, by using an air compressor outside the well (not illustrated), to center tripod assembly 500 in the well. In an embodiment, the expansion of the three elements can manipulate a diameter of tripod assembly from 500 to 650 mm. This helps to pin point a rotating motion of well rescue device 100 based on an available space between the victim and a wall of the well. Additionally, the three elements are configured to raise or lower well rescue device 100. The air compressor which extends the three elements can also be used for inflating first air bag 210 and second air bag 212 of clamp assembly 200. Alternately, the air compressor which extends the three elements can be used for inflating seat tube 104 of the seat assembly.

Tripod assembly 500 can further include a first motor 504 as shown in FIG. 3. First motor 504 is configured to control operation of the gripper such as controlling a movement of the gripper inside the well. Additionally, tripod assembly 500 can include a second motor 506 that is configured to control motion of clamp assembly 200. Further, tripod assembly 500 includes a steel pin 508 that is configured to provide support for a cable connection. The cable can be used to lift well rescue device 100.

Consider a scenario where a victim is trapped in a middle portion of a well. In accordance with the scenario, firstly well rescue device 100 is lowered to the portion of the well where the victim is trapped. Subsequently, the position of one or more of the clamp assembly and the seating assembly is adjusted. The gripper can be used to support the adjustment. Depending on how the victim is oriented, either or both of the clamp assembly and the seating assembly can be positioned. Further, the two assemblies can be moved simultaneously or one after the other for securing the victim with well rescue device 100. For positioning the clamp assembly, the clamping members are brought from an open position (similar to position illustrated in FIG. 1) to a close position (similar to position illustrated in FIG. 2) for securing the victim at one or more of the shoulder portion and the chest portion. Further, the gap between the clamping members can be adjusted as per the victim's dimensions to appropriately secure the victim with well rescue device 100. In order to position the seating assembly, the seat rod can be moved with respect to the clamp assembly for adjusting the gap between the seat tube and the clamp assembly if required. Thereafter, the seat tube's position with respect to the seat rod can be changed to an engaged position (similar to the position of the seat tube illustrated in FIG. 1). Subsequently, the seat tube can be inflated to provide the seating support to the victim. Once both the clamp assembly and the seating assembly have been appropriately positioned with respect to the victim, well rescue device 100 can be moved to bring the victim out of the well.

Consider another scenario, wherein the victim is at the bottom of the well. Here as well, firstly well rescue device 100 would be lowered followed by adjustment of the position of the clamp assembly and the seating assembly and movement of well rescue device 100 for bring the victim out of the well. However, in this case, one portion of a body of the victim would have to be raised using the gripper in order to facilitate positioning of the seat tube underneath the victim.

Various embodiments of the invention provide an improved well rescue device for rescuing a victim from a well. The well rescued device includes adjustable clamping members to provide support to one or more of a shoulder portion and the chest portion of the victim while moving the victim. A gap between the adjustable clamping members can be adjusted according to dimensions of the victim. Similarly, distance between the clamping members and a seat tube may be adjusted according to dimensions of the victim. The seat tube is connected to a seat rod and a length of the seat rod can be varied according to the dimensions of the victim. Thus, any victim trapped at any portion of the well can be rescued using the well rescue device.

Those skilled in the art will realize that the above recognized advantages and other advantages described herein are merely exemplary and are not meant to be a complete rendering of all of the advantages of the various embodiments of the invention.

In the foregoing specification, specific embodiments of the invention have been described. However, one of ordinary skill in the art appreciates that various modifications and changes can be made without departing from the scope of the invention as set forth in the claims below. Accordingly, the specification is to be regarded in an illustrative rather than a restrictive sense, and all such modifications are intended to be included within the scope of the invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A well rescue apparatus comprising:

a clamp assembly extendible for securing a victim to the well rescue apparatus, the clamp assembly configured to secure a shoulder or a chest of the victim while moving the victim;

a first linear actuator for extending and retracting the clamp assembly relative to the victim;

wherein the clamp assembly comprises two opposing clamping members configured to move relative to each other;

a second linear actuator attached between the two opposing clamping members for moving the two opposing clamping members relative to each other;

an inflatable airbag coupled to each of the two opposing clamping members to assist in securing the victim;

a rod slidably attached to the clamp assembly;

an inflatable seat tube attached to the rod for lifting the victim;

a motor configured to move the rod relative to the clamp assembly;

a tripod assembly having three elements extendible for engaging a wall defining a bore of a well to stabilize the well rescue apparatus within the well; and a connector for attaching the well rescue apparatus to a support cable from a surface opening of the well.

2. The well rescue apparatus of claim 1, wherein the rod comprises a slot configured to enable movement of the rod relative to the clamp assembly.

3. The well rescue apparatus of claim 1, wherein a position of the seat tube with respect to the rod is changeable in order to facilitate positioning of the seat tube for moving the victim.

4. The well rescue apparatus of claim 1, wherein the seat tube is configured to inflate to provide support to the victim while moving the victim.

5. The well rescue apparatus of claim 1, further comprising a camera attached to the clamp assembly, wherein the camera is configured to provide a video feed for moving the victim inside the well.

* * * * *